US010460849B2

(12) United States Patent
Li et al.

(10) Patent No.: US 10,460,849 B2
(45) Date of Patent: Oct. 29, 2019

(54) LIGHTWEIGHT, HIGH-CONDUCTIVITY, HEAT-RESISTANT, AND IRON-CONTAINING ALUMINUM WIRE, AND PREPARATION PROCESS THEREOF

(71) Applicant: CENTRAL SOUTH UNIVERSITY, Hunan (CN)

(72) Inventors: Hongying Li, Hunan (CN); Jie Bin, Hunan (CN); Zhaohe Gao, Hunan (CN)

(73) Assignee: CENTRAL SOUTH UNIVERSITY, Hunan (CN)

( * ) Notice: Subject to any disclaimer, the term of this patent is extended or adjusted under 35 U.S.C. 154(b) by 0 days.

(21) Appl. No.: 16/082,941

(22) PCT Filed: Mar. 24, 2017

(86) PCT No.: PCT/CN2017/078007

§ 371 (c)(1),
(2) Date: Sep. 7, 2018

(87) PCT Pub. No.: WO2017/162198

PCT Pub. Date: Sep. 28, 2017

(65) Prior Publication Data

US 2019/0096538 A1 Mar. 28, 2019

(30) Foreign Application Priority Data

Mar. 25, 2016 (CN) ..... 2016 1 0177708

(51) Int. Cl.
*C22C 21/00* (2006.01)
*H01B 1/02* (2006.01)
(Continued)

(52) U.S. Cl.
CPC ..... *H01B 1/023* (2013.01); *B22D 11/003* (2013.01); *C22C 21/00* (2013.01); *H01B 13/0036* (2013.01)

(58) Field of Classification Search
CPC .. H01B 1/023; H01B 13/0036; B22D 11/003; C22C 21/00
(Continued)

(56) References Cited

U.S. PATENT DOCUMENTS 3,807,016 A * 4/1974 Schoerner ..... C22C 21/00 420/538
3,807,969 A * 4/1974 Schoerner ..... C22C 21/00 420/537
(Continued)

FOREIGN PATENT DOCUMENTS

CN 102230113 11/2011
CN 102758107 10/2012
(Continued)

OTHER PUBLICATIONS

"International Search Report (Form PCT/ISA/210)", dated Jun. 30, 2017, with English translation thereof, pp. 1-4.

*Primary Examiner* — Timothy J Thompson
*Assistant Examiner* — Michael F McAllister
(74) *Attorney, Agent, or Firm* — JCIPRNET

(57) ABSTRACT

A lightweight, high-conductivity, heat-resistant, and iron-containing aluminum wire, and a preparation process thereof. The aluminum wire is mainly composed of aluminum, boron, zirconium, iron, lanthanum, and inevitable impurity elements, and the preparation process for the wire is as follows: melting industrial pure aluminum; then adding intermediate alloys of boron, zirconium, iron, and lanthanum to the melt; performing stirring, refining, furnace front component rapid analysis, component adjustment, standing, deslagging, and rapid cooling casting to obtain an aluminum alloy blank; and performing annealing, extrusion, and drawing on the cast blank to obtain an aluminum alloy monofilament. The wire obtained has density less than or equal to 2.714 g/cm3, electrical conductivity greater than or equal to 62% IACS, a short-term heat-resistance temperature as high as 230° C., a long-term heat-resistance temperature as high as 210° C., and tensile strength greater than or equal to 170 MPa.

23 Claims, 17 Drawing Sheets

(51) Int. Cl.
*B22D 11/00* (2006.01)
*H01B 13/00* (2006.01)

(58) Field of Classification Search
USPC ..... 174/126.2
See application file for complete search history.

(56) References Cited

U.S. PATENT DOCUMENTS

| | | | | |
|---|---|---|---|---|
| 4,082,573 | A * | 4/1978 | Schoerner | B21C 37/04 148/437 |
| 4,182,640 | A | 1/1980 | Yokota | |
| 5,512,241 | A * | 4/1996 | Kramer | B23K 35/286 148/437 |
| 7,550,675 | B2 * | 6/2009 | Susai | C22C 21/00 174/110 R |
| 7,615,127 | B2 * | 11/2009 | Elder | H01B 5/104 148/688 |
| 8,653,374 | B2 * | 2/2014 | Kusakari | B21C 1/00 174/126.1 |
| 9,453,272 | B2 * | 9/2016 | Vo | C22F 1/04 |
| 9,875,822 | B2 * | 1/2018 | Yoshida | C22C 21/08 |
| 2002/0162607 | A1 * | 11/2002 | Chadwick | C22C 21/00 148/415 |
| 2008/0156784 | A1 * | 7/2008 | Suzuki | B23K 35/3053 219/146.1 |

FOREIGN PATENT DOCUMENTS

| | | |
|---|---|---|
| CN | 102760508 | 10/2012 |
| CN | 102965550 | 3/2013 |
| CN | 102978458 | 3/2013 |
| CN | 105821253 | 8/2016 |
| DE | 2435456 | 2/1975 |
| GB | 1292508 | 10/1972 |

* cited by examiner

| Element | Wt% | At% |
|---|---|---|
| BK | 59.40 | 81.53 |
| AlK | 25.13 | 13.82 |
| TiK | 07.66 | 02.37 |
| VK | 07.82 | 02.28 |
| Matrix | Correction | ZAF |

| Element | Wt% | At% |
|---|---|---|
| AlK | 90.94 | 95.41 |
| FeK | 09.06 | 04.59 |
| Matrix | Correction | ZAF |

| *Element* | *Wt%* | *At%* |
|---|---|---|
| *AlK* | 89.62 | 78.58 |
| *BK* | 10.38 | 21.42 |
| *Matrix* | Correction | ZAF |

2010002533A

Reference No: MT2013-0514-B

Test Report

Name of products: Aluminum Wire

Type: See the comments

Consignor: School of Materials Science and Engineering, Central South University Kind of test: Requested Test MACHINERY INDUSTRY QUALITY SUPERVISION AND TEST CENTER FOR ELECTRICAL MATERIAL AND SPECIAL WIRE & CABLE

FIG. 6

MACHINERY INDUSTRY QUALITY SUPERVISION AND TEST CENTER FOR ELECTRICAL MATERIAL AND SPECIAL WIRE & CABLE

Test Report

| | | | | | | |
|---|---|---|---|---|---|---|
| Name of products | Aluminum wire | | | | | |
| Type | See the comments | | | State description | Silver-white, linear, test requirements satisfied | |
| Kind of test | Entrusted test | | | Reference No. | MT2013-0514-B | |
| Consignor | School of Materials Science and Engineering, Central South University | | | Address | School of Materials Science and Engineering, Central South University, South Lushan Road, Changsha, Hunan Province | |
| Produced by | School of Materials Science and Engineering, Central South University | | | Sample arrival date | April 18, 2013 | |
| Sampling manner | Sent by the consignor | Sent by | Li Hongying | Zip code | 410083 | Tel.13973118109 13973118109 |
| Test basis | Technical parameters provided by the School of Materials Science and Engineering, Central South University | | | | | |
| Date of test | April 18, 2013 to April 22, 2013 | | | | | |
| Conclusion | The 3 properties of the sample all conform to the technical parameters provided by the School of Materials Science and Engineering, Central South University | | | | | |
| Comments | Sample type:Φ4×1500mm2#; Φ 4 × 1500mm3# | | | | | |
| Date of compilation | April 22, 2013, by Hu Cong | Date of review | April 22, 2013, by Lu Shengye | Date of approval | April 22, 2013, by Huang Guofei | |

FIG. 7

| Sample type | | Φ4× 1500mm 3# | | Reference No.: MT2013-0514-B | |
|---|---|---|---|---|---|
| Serial No. | Test item | Unit | Standard requirements | Test result | Conclusion |
| 1 | Electrical conductivity | % IACS | >61 | 62 | √ |
| 2 | Tensile strength | MPa | ≥160 | 170 | √ |
| 3 | Strength survival rate (230°C, 1 h) -Blank below- | % | ≥90 | 91 | √ |

Notes: "√"indicates that the item is up to standards, and"×" indicates that the item is not up to standards.

FIG. 8

Reference No.: MT2013-0514-B Attached sheet

| Serial No. | Device name | Device No. | Date of validity |
|---|---|---|---|
| 1 | Resistance test instrument for digital wire and cable conductors | D142 | August 30, 2013 |
| 2 | Outside micrometer | D135 | August 8, 2013 |
| 3 | Microcomputer-controlled electronic universal testing machine | J063 | May 11, 2013 |

FIG. 9

LIGHTWEIGHT, HIGH-CONDUCTIVITY, HEAT-RESISTANT, AND IRON-CONTAINING ALUMINUM WIRE, AND PREPARATION PROCESS THEREOF

CROSS-REFERENCE TO RELATED APPLICATION

This application is a 371 application of International PCT application serial no. PCT/CN2017/078007, filed on Mar. 24, 2017, which claims the priority benefit of Chinese application no. 201610177708.3, filed on Mar. 25, 2016. The entirety of each of the above-mentioned patent applications is hereby incorporated by reference herein and made a part of this specification.

BACKGROUND

Technical Field

The present invention relates to the technical field of electrical engineering materials, and to an aluminum wire for power lines and electrical cables, and specifically, to a lightweight, high-conductivity, heat-resistant, and iron-containing aluminum wire used for overhead power supply and power transformation lines, and a preparation process thereof.

Description of Related Art

At present, heat-resistant wires used in power supply and power transformation lines in urban and rural areas of China have a long-term operating temperature that generally does not exceed 180° C. and electrical conductivity equal to or less than 61% IACS, causing higher line losses. According to the requirements on the development of national economy of China and the interconnection of energy sources, power transmission lines are to be developed into high-voltage, high-capacity and long-distance power transmission lines. In order to save insufficient corridor resources, reduce line construction costs, and reduce transmission line losses, it is strictly required that power transmission wires should not only have high electrical conductivity but also have satisfactory heat resistance and an excellent anti-sagging property.

In general, there is a tradeoff relationship between electrical conductivity and heat resistance and between electrical conductivity and strength. Micro-alloying is an effective way to improve heat resistance and strength of aluminum conductors, but it causes adverse impact to electrical conductivity. High purity aluminum with purity of 99.99% has electrical conductivity of 64.94% IACS at 20° C., density of 2.7 g/cm$^3$, strength of only 80-100 MPa, and a recrystallization temperature of about 150° C. Alloy 6021 added with alloy elements such as 0.6-0.9 wt. % Mg, 0.5-0.9 wt. % Si, 0.5 wt. % Fe, 0.1 wt. % Cu and 0.1 wt. % Zn is commonly-used high-strength electrical engineering aluminum, and its tensile strength may be as high as 295-325 MPa, but its electrical conductivity is merely 52.5-55% IACS at 20° C. Therefore, development of low-cost wires with high electrical conductivity, satisfactory heat resistance, and high specific strength has become a difficult technical problem urgently to be addressed in the industry.

Chinese patent CN102230113A discloses a heat-resistant aluminum alloy conductor material and a preparation process thereof. An aluminum conductor material obtained by means of zirconium-erbium composite micro-alloying has electrical conductivity ranging from 59.5% IACS to 60.5% IACS, a long-term heat-resistance temperature of 180° C., and tensile strength lower than 160 MPa. Chinese patent CN102965550A discloses a high-strength, high-conductivity, and heat-resistant aluminum conductor material and a preparation process thereof. Al(Tm, Fe) phases in the shape of fine particles and $Al_3$(Tm, Zr) shell-core structure phases that are dispersively distributed are obtained by means of zirconium-thulium-iron composite micro-alloying and isothermal precipitation and annealing processes, which substantially increase heat resistance and strength of aluminum conductor materials, and the prepared aluminum conductor material have a long-term heat-resistance temperature as high as 210° C., and tensile strength above 185 MPa, but its maximum electrical conductivity is only 60.8% IACS. Chinese patent CN102758107A discloses a high-strength, high-conductivity, and heat-resistant aluminum alloy wire and a preparation process thereof. Six alloy elements are added, including as many as three rare earth elements, and a zirconium element with a high content of 0.15%-0.60% is added. An annealing time of the alloy wire is as long as 30-50 hours, and the prepared aluminum conductor material can stand up to trial operation for 1 hour while being heated at 280° C. However, it has tensile strength lower than or equal to 160 MPa, electrical conductivity lower than or equal to 61.8% IACS, and a long-term heat-resistance temperature of only 180° C.

SUMMARY

Technical Problem

An objective of the present invention is to overcome disadvantages of the prior art and provide a lightweight, high-conductivity, and heat-resistant aluminum wire that has a proper component ratio, a short production flow, a simple process, and low production costs, and a preparation process thereof. According to the present invention, a wire produced by adding a small quantity of alloy elements that have little impact on electrical conductivity and employing proper processes and actions such as purification, modification, refining and dispersion strengthening has a substantial increase in heat resistance and specific strength while the electrical conductivity slightly decreases, when compared to high purity aluminum with purity of 99.99%. Moreover, according to the present invention, by utilizing the effect of boron for modifying iron-containing phases and the effect of extrusion for crushing bulky iron-containing phases, the beneficial effect of iron on the overall performance of aluminum alloys is achieved while the costs of controlling iron are reduced.

Solution to the Problem

Technical Solution

A lightweight, high-conductivity, heat-resistant, and iron-containing aluminum wire of the present invention includes the following components in percentage by weight:

B 0.04-0.10 wt. %;

Zr 0.10-0.15 wt. %;

Fe 0.10-0.20 wt. %;

La 0.05-0.30 wt. %; and inevitable titanium, vanadium, chromium, and manganese with a total content less than 0.01 wt. %, and aluminum as the remaining, preferably a content of B in the alloy components being 0.045-0.095 wt. %, and more preferably the content of B being 0.055-0.08 wt. %.

According to the lightweight, high-conductivity, heat-resistant, and iron-containing aluminum wire of the present invention, during casting, cooling is performed to a room temperature at a rate of 20-300° C./s and then high temperature rapid annealing is performed at 480° C.-500° C. for 1-10 h.

According to the lightweight, high-conductivity, heat-resistant, and iron-containing aluminum wire of the present invention, the wire has nanoscale spherical $Al_3$(Er, Zr) composite particles.

According to the lightweight, high-conductivity, heat-resistant, and iron-containing aluminum wire of the present invention, the nanoscale spherical $Al_3$(Er, Zr) composite particles are of an L12 structure coherent with a matrix.

A process for preparing a lightweight, high-conductivity, heat-resistant, and iron-containing aluminum wire of the present invention includes: separately selecting industrial pure aluminum and aluminum-boron, aluminum-zirconium, aluminum-iron and aluminum-lanthanum intermediate alloys according to a designed alloy component ratio; melting the industrial pure aluminum at 740-780° C.; then adding the intermediate alloys; after the intermediate alloys are completely melt, keeping the melt at 720° C.-740° C.; performing stirring, refining, furnace front component rapid analysis, component adjustment, standing, and deslagging, and then performing rapid cooling casting at 700-720° C.; and then performing annealing, extrusion, and drawing on the blank to obtain an aluminum alloy monofilament.

According to the process for preparing a lightweight, high-conductivity, heat-resistant, and iron-containing aluminum wire of the present invention, during the casting, an ingot blank may be obtained by common casting or semi-continuous casting; or a rod blank may be obtained by continuous casting.

According to the process for preparing a lightweight, high-conductivity, heat-resistant, and iron-containing aluminum wire of the present invention, during the casting, the cast ingot is cooled to a room temperature at a rate of 20-300° C./s.

According to the process for preparing a lightweight, high-conductivity, heat-resistant, and iron-containing aluminum wire of the present invention, water-cooling casting is employed during the casting.

According to the process for preparing a lightweight, high-conductivity, heat-resistant, and iron-containing aluminum wire of the present invention, the annealing process for the blank includes: performing the annealing at a temperature of 480° C.-500° C., and performing furnace cooling after thermal insulation for 2-10 h.

According to the process for preparing a lightweight, high-conductivity, heat-resistant, and iron-containing aluminum wire of the present invention, a manner of extrusion may be changed according to a configuration of production line equipment, and conventional hot extrusion may be performed on a heated ingot blank, and further, continuous extrusion may be performed on the rod blank at a room temperature, with an extrusion temperature being 300-450° C.

According to the process for preparing a lightweight, high-conductivity, heat-resistant, and iron-containing aluminum wire of the present invention, an extrusion ratio for the hot extrusion or the continuous extrusion at the room temperature is greater than or equal to 80, and a total extrusion deformation amount is greater than or equal to 80%.

According to the process for preparing a lightweight, high-conductivity, heat-resistant, and iron-containing aluminum wire of the present invention, during the drawing, multiple passes of cold drawing are performed on the extruded rod; a diameter of the blank for drawing may be determined based on actual needs, and in particular the diameter of the used blank may be determined based on required service strength; and strength of the monofilament may be adjusted and controlled according to different drawing deformation amounts.

According to the process for preparing a lightweight, high-conductivity, heat-resistant, and iron-containing aluminum wire of the present invention, multiple passes of drawing are performed after the extrusion, a coefficient of elongation for the passes being 1.2-1.5 and an accumulative total coefficient of elongation being 5.5-10.5; lubrication may be performed with a common lubricating oil or an emulsion; the emulsion can also be used for cooling, so that a temperature of the aluminum wire does not exceed 180° C.

According to the process for preparing a lightweight, high-conductivity, heat-resistant, and iron-containing aluminum wire of the present invention, the prepared wire has density less than or equal to 2.714 g/cm$^3$, electrical conductivity greater than 62% IACS at 20° C., a long-term heat resistance temperature as high as 210° C., a strength survival rate after annealing at 230° C. for 1 hour greater than 91%, and tensile strength greater than or equal to 170 MPa.

To sum up, according to the present invention, a small quantity of alloyed elements are added and a content is low; a proper ratio for elements such as aluminum, boron, zirconium, lanthanum, and iron is utilized; rapid cooling casting, high-temperature short-time annealing of the cast blank, and extrusion at a high deformation degree are employed; associated effects such as purification, modification, refining, and strengthening, in particular cast blank annealing, are produced; and the precipitated wire has relatively improved dispersive strengthening and satisfactory heat resistance. The wire prepared according to the present invention has density relatively close to density of pure aluminum (<2.715 g/cm$^3$), electrical conductivity remaining above 62% IACS, tensile strength above 170 MPa, a long-term heat-resistance temperature as high as 210° C., and a short-term heat-resistance temperature as high as 230° C. Further advantages of the present invention include a short production flow, a simple process, low requirements, and relatively low production costs, and the prepared aluminum alloy wire can meet requirements of long-distance and high-capacity power transmission lines on high electrical conductivity, high heat resistance, and high specific strength.

Beneficial Effects of the Present Invention

Beneficial Effects

A current is formed by a directional movement of free electrons in metal under the action of an applied electric field, but periodic abnormal points (or irregular points) in a lattice field hinder the directional movement of the electrons and cause a scattering effect to electron waves. Electrical conductivity of metallic materials is closely related to a mean free path (an average of distances between adjacent abnormal points) of free electrons, and a smaller mean free path of the free electrons indicates lower electrical conductivity of the materials. Impurity elements, solid-dissolved atoms, and crystal defects in metal all cause the lattice field to locally offset from its periodic locations and shorten the mean free path of free electrons, resulting in a decrease in electrical conductivity of the metal. Inevitable impurity elements in industrial pure aluminum such as titanium, vanadium, chromium, manganese, silicon, and iron greatly affect electrical conductivity, and particularly when a large quantity of impurity elements is solid-dissolved in an aluminum matrix, electrical conductivity of an aluminum conductor is greatly reduced. Solid-dissolved atoms result in lattice distortions to destroy periodicity of the Coulomb potential field of pure metals and become scattering centers of conductive electrons. A small quantity of zirconium elements that are solid-dissolved in an aluminum matrix may obviously reduce electrical conductivity of alloys, and a higher molarity of the solid-dissolved atoms indicates a smaller distance between adjacent scattering centers, a smaller mean free path of the electrons, and lower electrical conductivity. Therefore, micro-alloying that is intended to improve heat resistance and strength of aluminum conductors causes very disadvantageous impact to electrical conductivity, especially when alloy components and their ratios are improperly designed.

An iron element is generally defined as a harmful impurity element of an aluminum alloy, and it should be removed. This is because during casting, iron tends to precipitate skeleton phases at a grain boundary that are distributed like continuous webs, and when content of iron is relatively high, iron-containing phases in the shape of laminates or needles may appear, which is extremely disadvantageous to strength and toughness of the alloy. It is difficult to remove these continuous web-like iron-containing phases by heat treatment, and they may further adversely affect processability of the alloy. A form and distribution of the iron-containing phases may be changed by adding a modifier and employing suitable processes such as smelting, casting, and plastic deformation, so that the iron-containing phases are distributed in the aluminum matrix in the shape of fine particles. This can effectively prevent dislocations and grain boundary movement, to cause the alloy to have high strength and heat resistance, and has little impact on electrical conductivity.

According to the present invention, boron with a high content (>0.04 wt. %) is added, which mainly functions for modification, as well as matrix purification. The purification function of boron in the present invention is mainly embodied in the reaction with impurity elements such as titanium, vanadium, chromium, and manganese to generate compounds with high specific gravity that sink to the bottom of a furnace and are discharged as slag, thereby effectively purifying the alloy matrix. The modification function of boron in the present invention is mainly embodied in improvement of a shape and distribution of the iron-containing phases, which can not only improve overall performance of the alloy, but also can lower requirements on the purity of raw materials and costs of controlling iron. It can be said that multiple purposes are achieved. The inventors have found that: an objective of effectively improving electrical conductivity cannot be achieved when a content of boron is low or excessively high. When the content of boron is 0.035 wt. %, as shown in FIG. 3(*a*) and FIG. 3(*b*), basically, aluminum-iron phases are continuously distributed at the grain boundary in the shape of skeletons or form a eutectic structure in the shape of laminates, with corresponding electrical conductivity of the wire being 59.5% IACS. When the content of boron is 0.04 wt. %, as shown in FIG. 3(*c*) and FIG. 3(*d*), a small quantity of discontinuous aluminum-iron phases appears in the alloy in the shape of short stripes or dots, but there are still many aluminum-iron phases in the shape of continuous webs. When the content of boron is increased to 0.1 wt. %, formation of web-like and laminated aluminum-iron phases is effectively prevented, and as shown in FIG. 3(*e*) and FIG. 3(*f*), aluminum-iron phases are mainly in the shape of discontinuous stripes or dots, so that electrical conductivity, strength, and heat stability of the aluminum wire are improved to different extents. When the content of boron is 0.12 wt. %, as shown in FIG. 3(*g*) and FIG. 3(*h*), many bulky aluminum-boron phases appear in the alloy, with corresponding electrical conductivity of the wire being only 60.2% IACS.

Compared to patent CN102758107A, content of added zirconium elements in the present invention is lower, which weakens adverse impact of zirconium on electrical conductivity of an alloy, and at the same time, rapid solidification of a melt can prevent formation of bulky primary $Al_3Zr$ particles, so that zirconium mainly exists in a metastable supersaturated solid-dissolved state and a large number of fine $Al_3Zr$ particles that are dispersively distributed and coherent with a matrix are precipitated during a subsequent annealing process, thereby substantially improving heat resistance and strength of the alloy.

An added lanthanum element in the present invention possibly has three functions: the first function is refining such as degassing and impurity removal, in which electrical conductivity of an alloy is improved by reducing a content of hydrogen and an impurity content in a melt; the second function is improvement of strength and toughness of a cast blank by refining a grain structure and a dendritic structure; and the third function is formation of fine $Al_3(Zr, La)$ composite phases during annealing, to prevent growth of the grain boundary and subgrain boundary and migration of dislocations, thereby strengthening the alloy and improving its heat resistance.

Preparation processes employed in the present invention such as casting, annealing, extrusion, and drawing are distinct from other continuous casting and rolling processes for aluminum wires, and have such advantages as a short production flow and a simple and flexible process. The prepared wire has satisfactory heat resistance and specific strength, while high electrical conductivity is ensured. Rapid cooling casting of the present invention achieves a function of preventing formation of bulky primary aluminum-zirconium phases and aluminum-iron phases to some extent, causes a cast blank to have high supersaturated solid solubility, and provides a driving force for fine dispersively-distributed second-phase particles precipitated during a subsequent annealing process. High-temperature and short-term annealing for cast blanks of the present invention has a main function of precipitating fine dispersively-distributed zirconium-containing second-phase particles such as $Al_3Zr$, and a secondary function of suitably removing component segregation, structure segregation, and casting stress of a blank, thereby improving a cast structure and processability. Further, compared to a homogenizing annealing time of aluminum alloys and thane annealing time in disclosed patents, an annealing time in the present invention is shorter, which causes the present invention to be advantageous in energy saving and consumption reduction. Plastic deformation is performed in the present invention by way of extrusion, which causes the present invention to have such advantages as flexible production and a simple process. A wire rod can be formed by using one extrusion process for an ingot blank, and a coiled wire blank with a smaller diameter can be formed by continuous extrusion for a continuously cast rod blank. Compared with rolling deformation, the plastic deformation has a greater deformation degree and a stronger triaxial compressive stress state, and can greatly improve a cast structure and increase subsequent processability, and in particular achieves a function of crushing bulky brittle aluminum-iron phases at the grain boundary to some extent.

According to the present invention, multiple passes of cold drawing are performed on an extruded rod to obtain an aluminum alloy monofilament; a diameter of the rod may be determined based on actual needs, and in particular the diameter of the rod used may be determined based on a required service strength; and strength of the monofilament may be adjusted and controlled by different drawing deformation amounts.

To sum up, according to the present invention, a proper ratio of elements such as aluminum, boron, zirconium, lanthanum, and iron is used; rapid cooling casting, high-temperature short-term annealing of a cast blank, and extrusion at a high deformation amount are employed; and associated effects such as purification, modification, refining, and strengthening and toughening are produced. The present invention is short in production flow, simple and flexible in process, and low in requirements; a quantity of added alloyed elements is small and a content is low, to reduce usage of expensive rare earth elements; no strict requirements are placed on a content of impurities in raw materials and quality of the cast blank, and energy consumption is not high, so that there is also an advantage of low production costs. the prepared wire has electrical conductivity greater than or equal to 62% IACS at 20° C., a long-term heat-resistance temperature as high as 210° C., a short-term heat-resistance temperature as high as 230° C., tensile strength above 170 MPa, and density (≤2.714 g/cm$^3$) closer to density of pure aluminum (2.7 g/cm$^3$). The wire can meet requirements of long-distance and high-capacity power transmission lines, and its high electrical conductivity may increase a capacity of the power transmission lines and decrease transmission line losses. Its satisfactory heat resistance can improve safety and stability as well as a service life of the lines. Its high specific strength can improve an anti-sagging property of the lines and increase a distance between towers and poles for the power transmission lines. Therefore, the present invention has significant economic benefits and is of significance in energy saving and environmental protection.

BRIEF DESCRIPTION OF THE DRAWINGS

FIG. 3(*b*) is an energy spectrum analysis result of a second phase in FIG. 3(*a*).

FIG. 3(*c*) is an SEM photograph of an alloy of Embodiment 1.

FIG. 3(*d*) is an energy spectrum analysis result of a second phase in FIG. 3(*c*).

FIG. 3(*e*) is an SEM photograph of an alloy of Embodiment 3.

FIG. 3(*f*) is an energy spectrum analysis result of a second phase in FIG. 3(*e*).

FIG. 3(*g*) is an SEM photograph of an alloy of comparative example 2.

FIG. 3(*h*) is an energy spectrum analysis result of a second phase in FIG. 3(*g*).

FIG. 4(*b*) is a metallograph of a cast structure of an alloy of Embodiment 3.

FIG. 5(*b*) is a TEM photograph of an alloy of Embodiment 3, in which there is a second phase pinning grain boundary.

FIG. 6 to FIG. 9 are test reports for the performance of a 04 aluminum wire prepared according to Embodiment 3 of the present invention.

DESCRIPTION OF THE EMBODIMENTS

Figure 1:
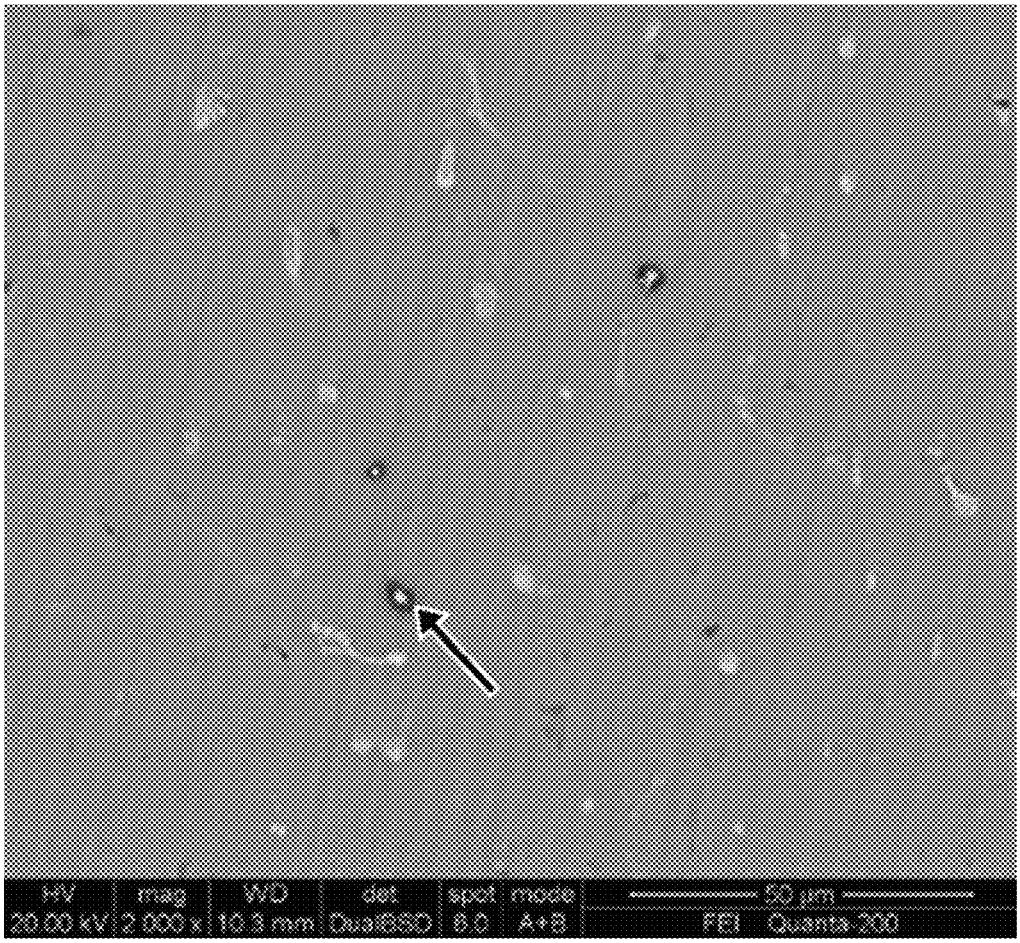
FIG. 1 is a microstructure morphology of slag of Embodiment 1.
Figure 2:
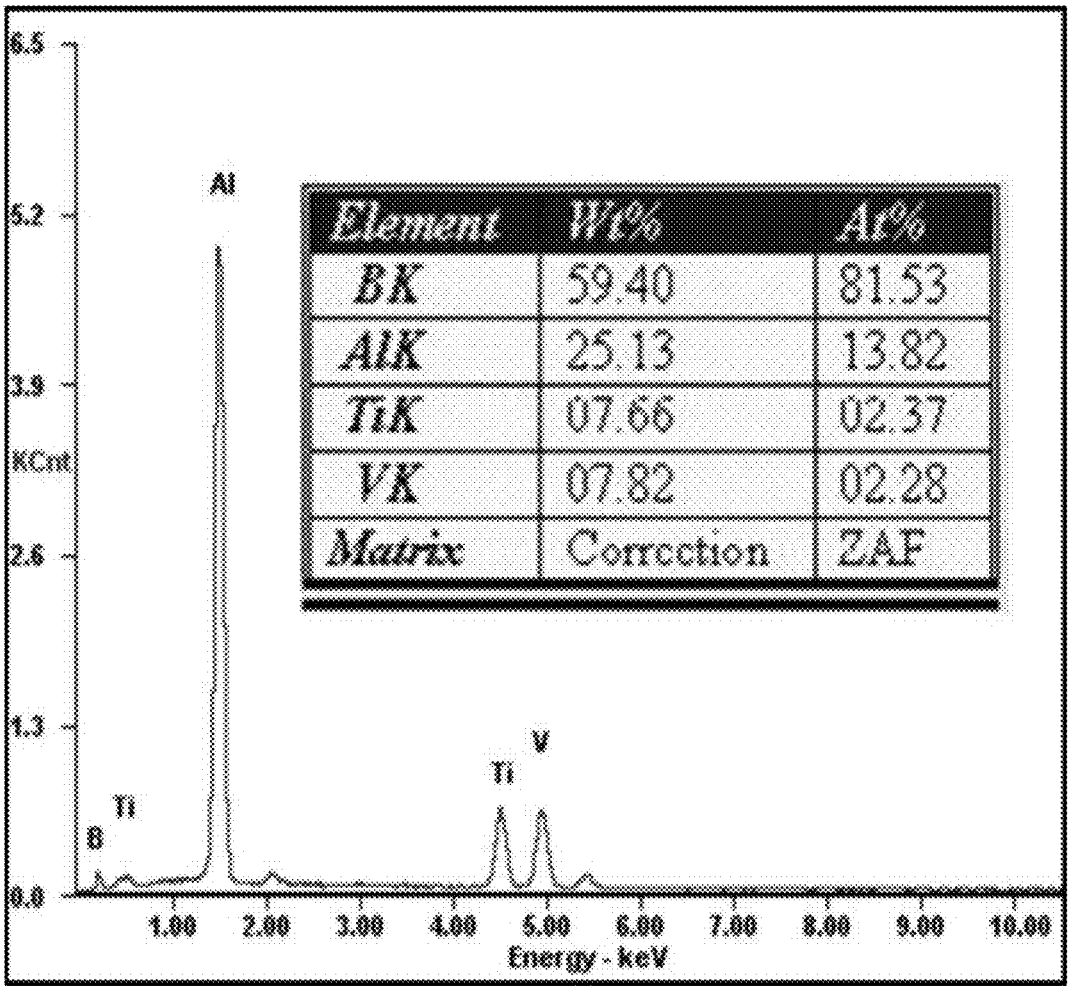
FIG. 2 is an energy spectrum analysis result of a mass point in FIG. 1.
Figure 3A:
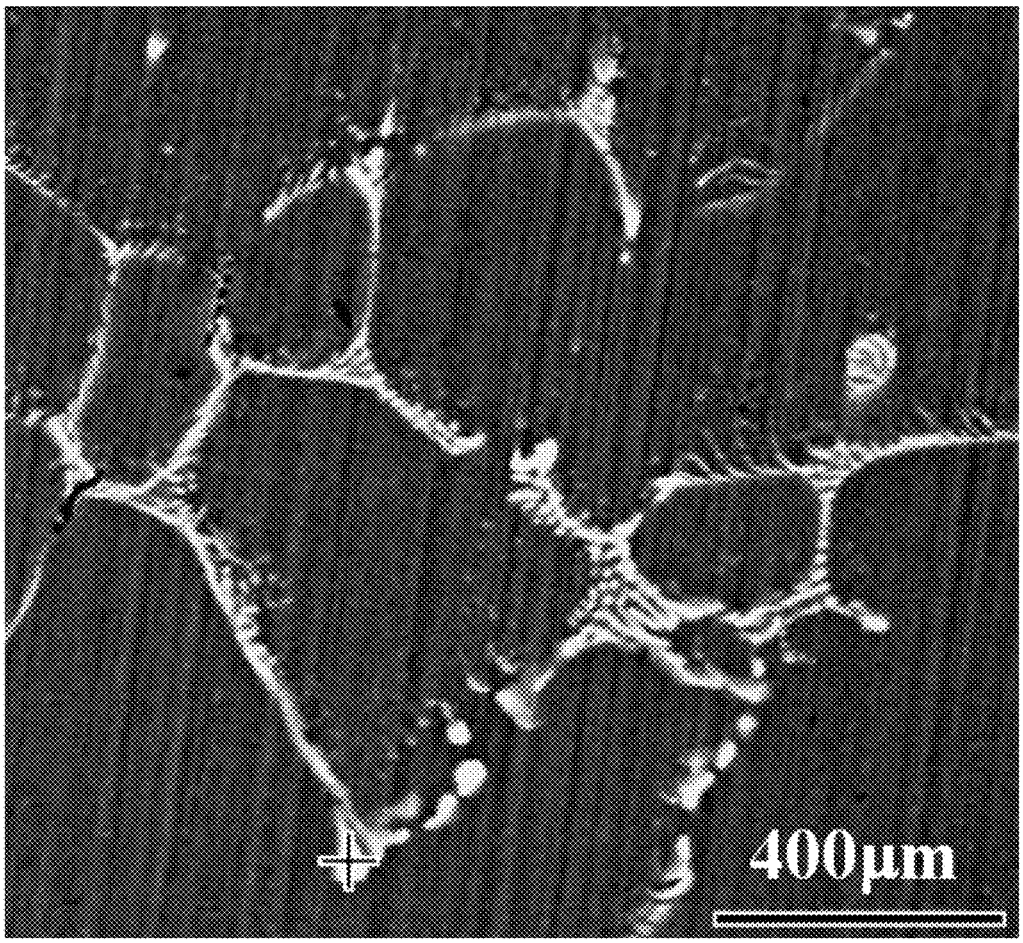
FIG. 3(*a*) is an SEM photograph of an alloy of comparative example 1.
Figure 3B:
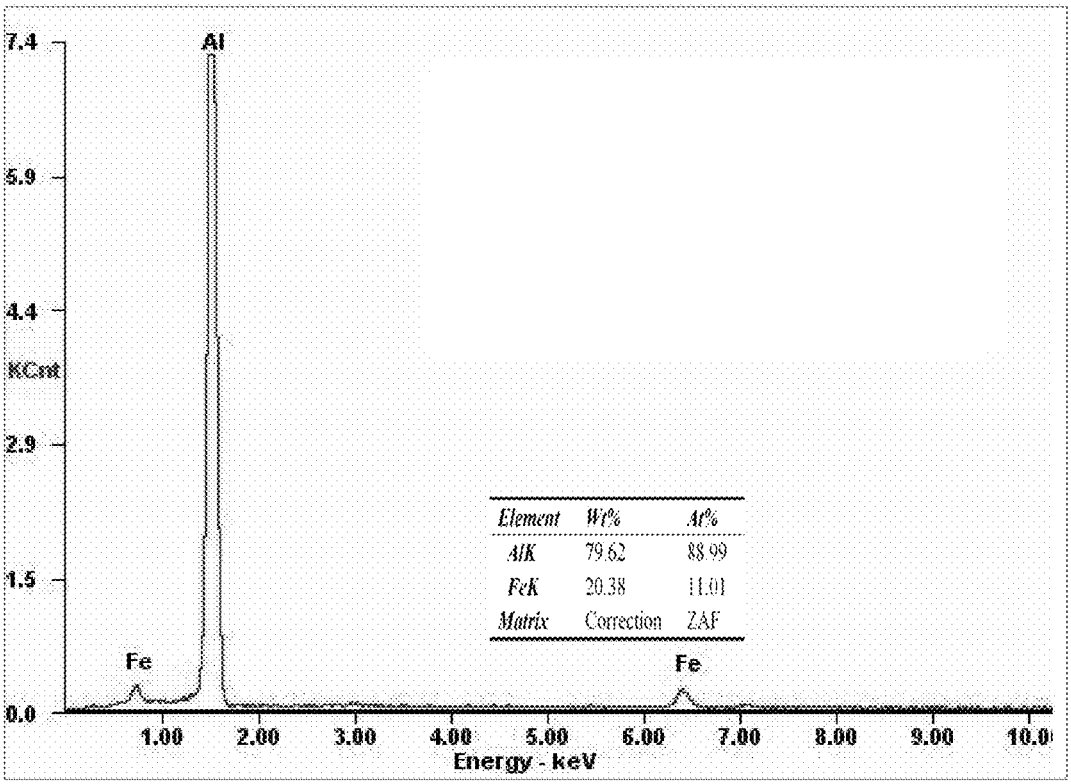
Figure 3C:
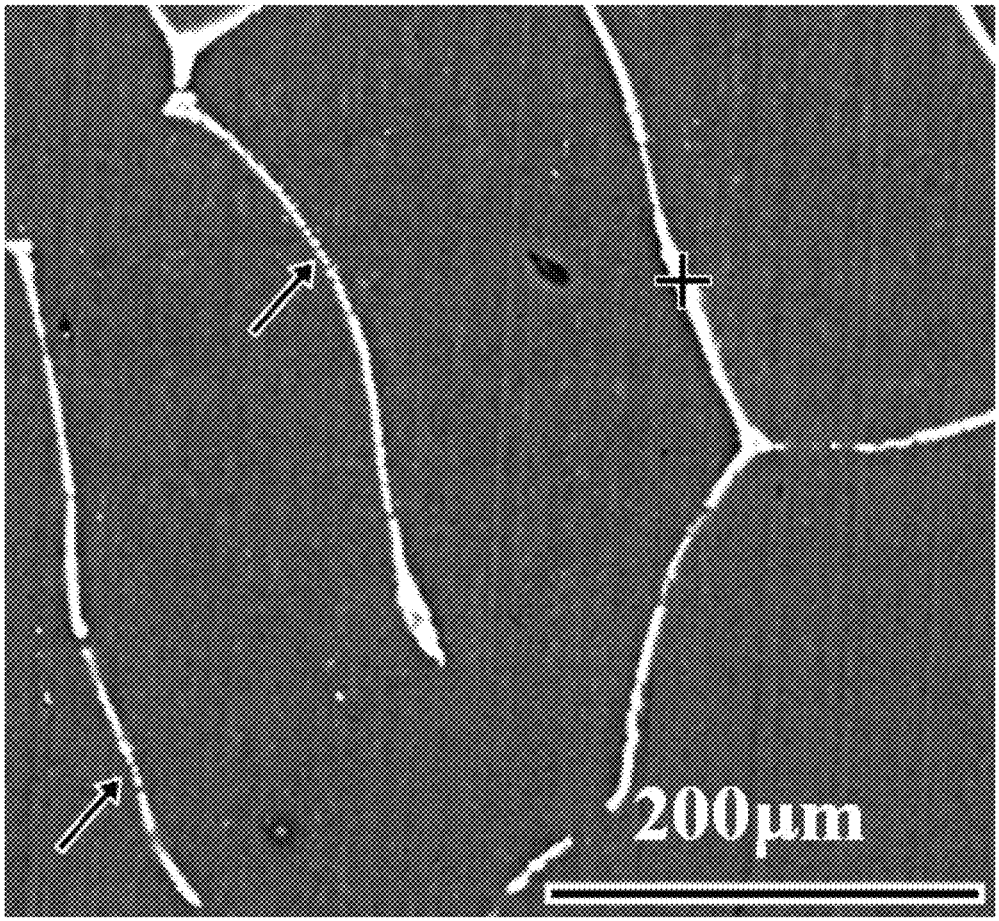
Figure 3D:
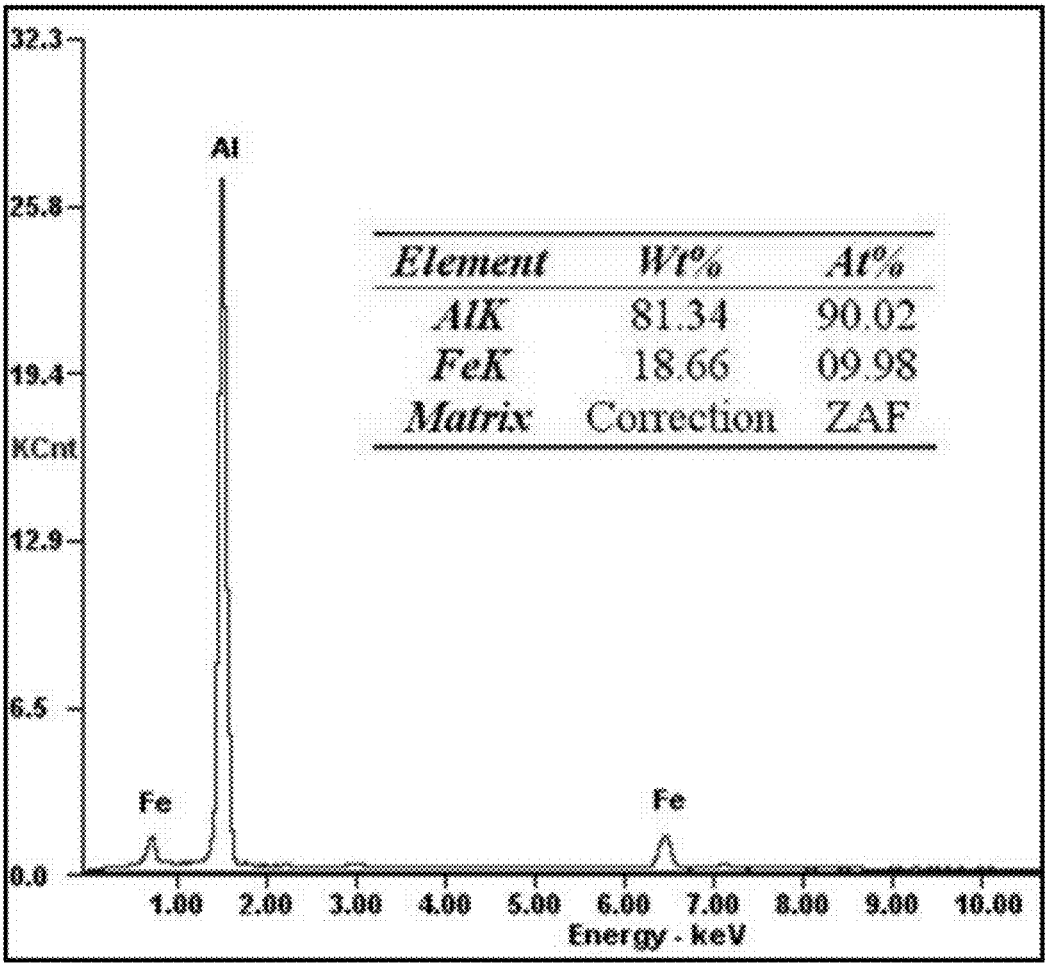
Figure 3E:
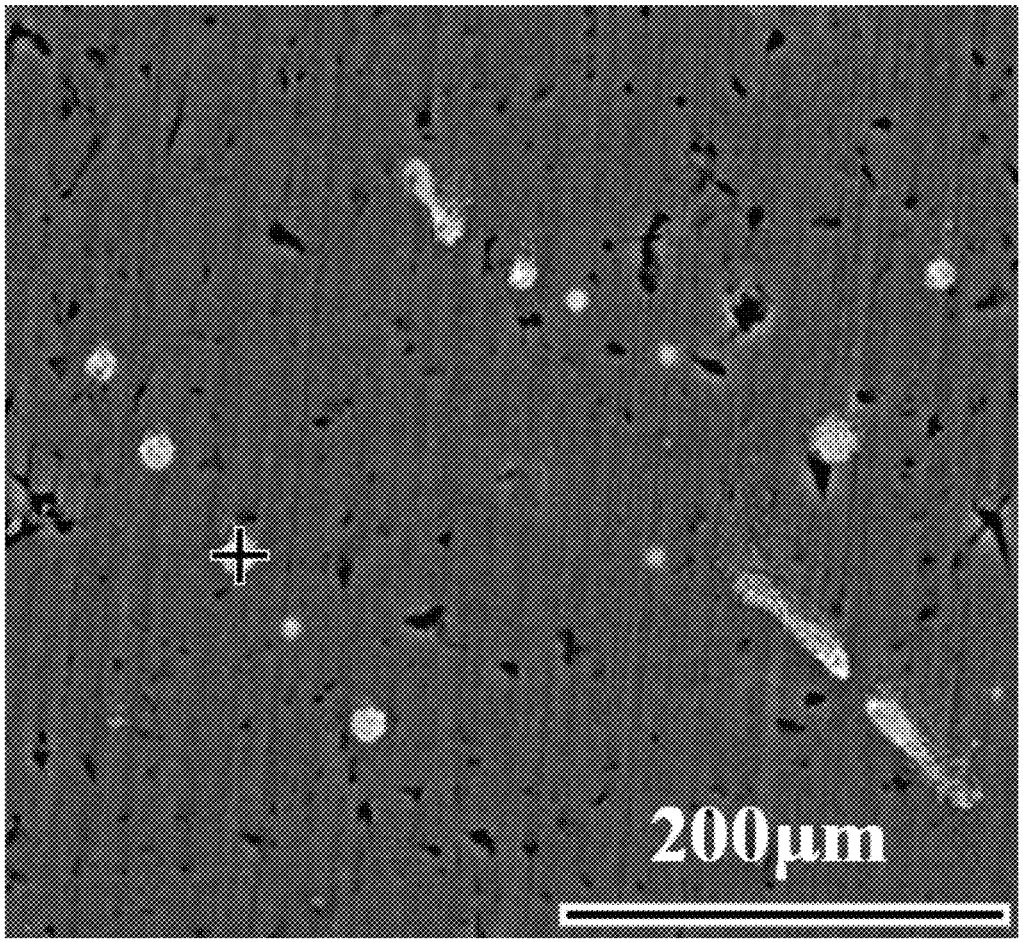
Figure 3F:
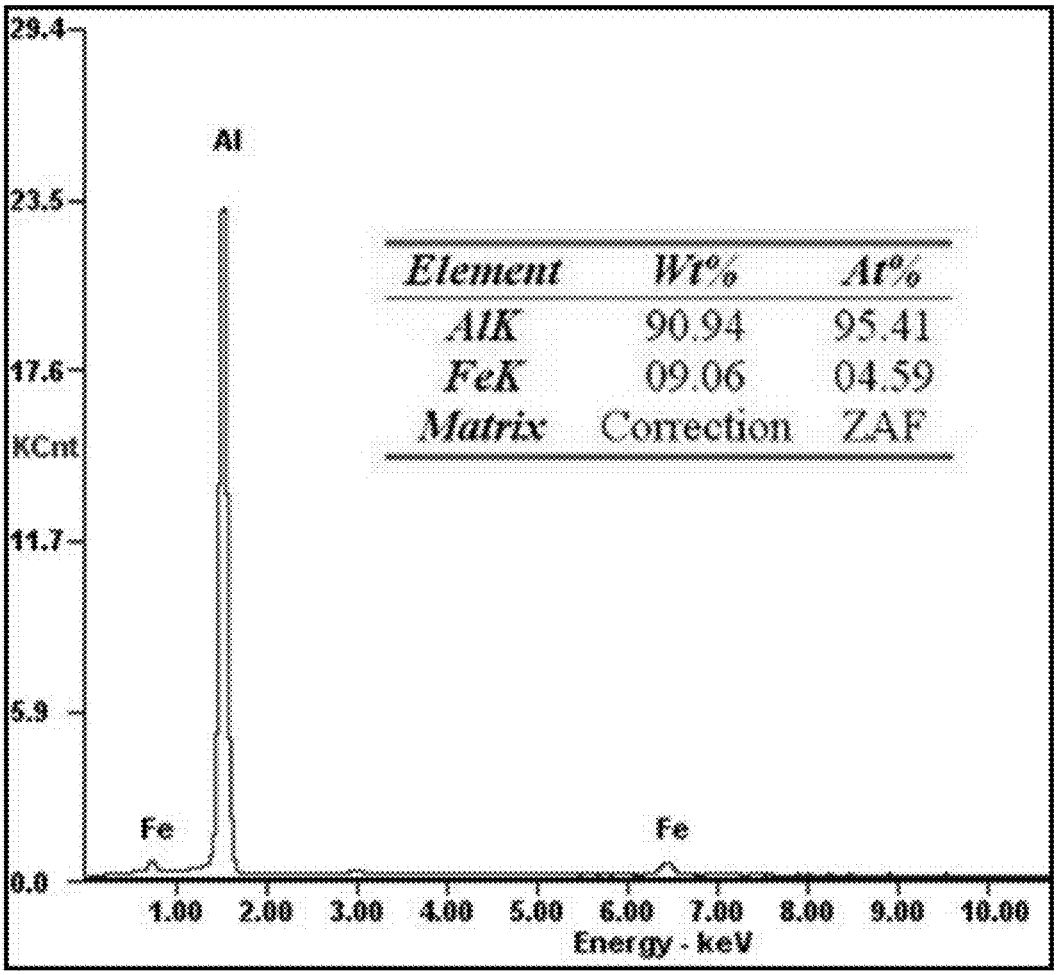
Figure 3G:
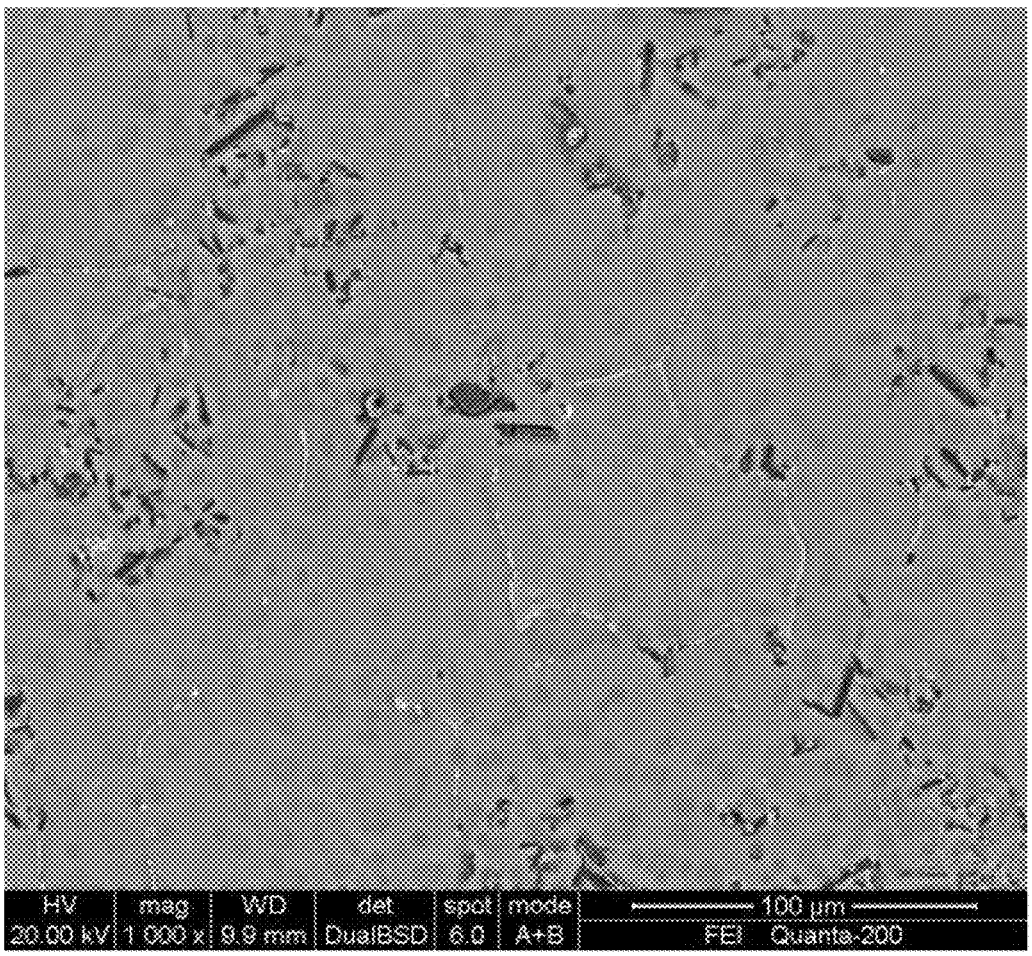
Figure 3H:
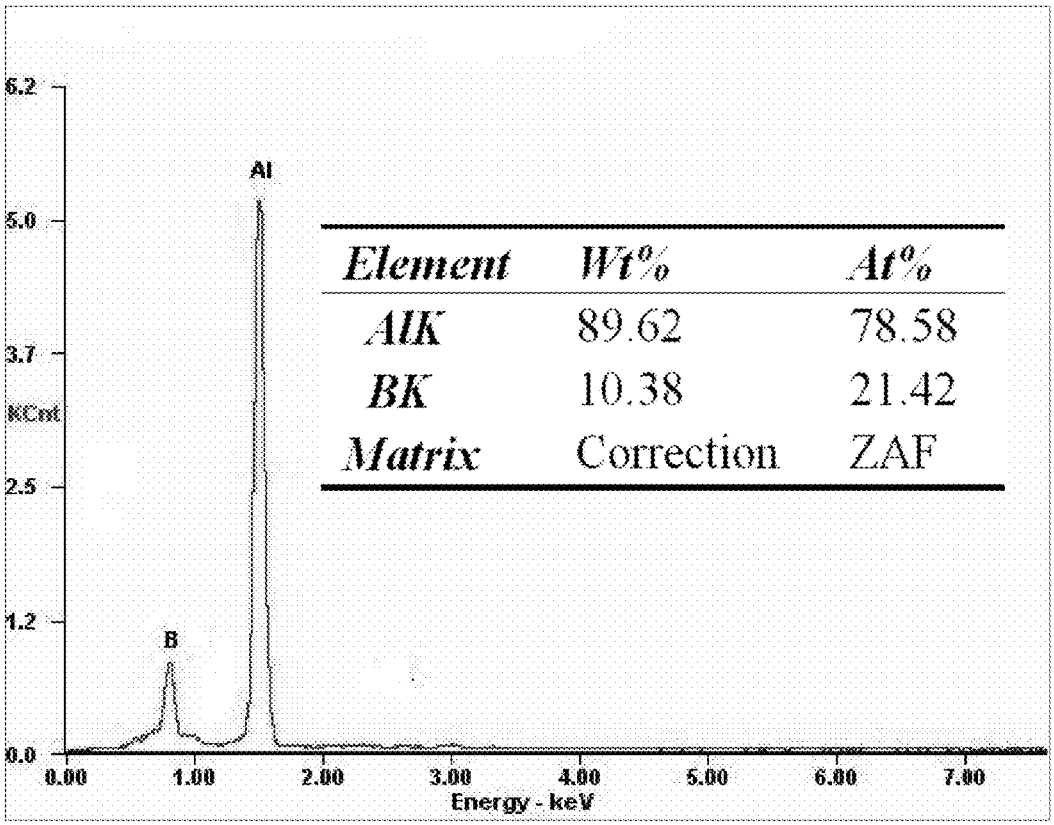

In FIG. 1, a white second phase is an aluminum-iron phase, and at the same time there is a particle which is relatively dark outside and bright white in the middle (as shown by the arrow) in a matrix. An energy spectrum analysis in FIG. 2 shows that the particle is a phase containing aluminum, boron, titanium, and vanadium, which indicates that impurity elements such as titanium and vanadium may react with the boron element to generate a compound which is removed in the form of slag during smelting, thereby improving electrical conductivity of the alloy.

As can be learned from FIG. 3(*a*) and FIG. 3(*b*), when a content of boron is 0.035 wt. %, the aluminum-iron phase in the alloy is mainly in the shape of continuous skeletons, and there is a eutectic structure in the shape of laminates. As can be learned from FIG. 3(*c*) and FIG. 3(*d*), when a content of boron is 0.04 wt. %, part of the aluminum-iron phase is in the shape of discontinuous short stripes or dots, as indicated by the arrow in FIG. 3(*c*). As can be learned from FIG. 3(*e*) and FIG. 3(*f*), when a content of boron is increased to 0.1 wt. %, the aluminum-iron phase in the alloy is mainly in the form of discontinuous stripes or dots. As can be learned from FIG. 3(*g*) and FIG. 3(*h*), when a content of boron is 0.12 wt. %, a large quantity of bulky aluminum-boron phases appears in the alloy.

Figure 4A:
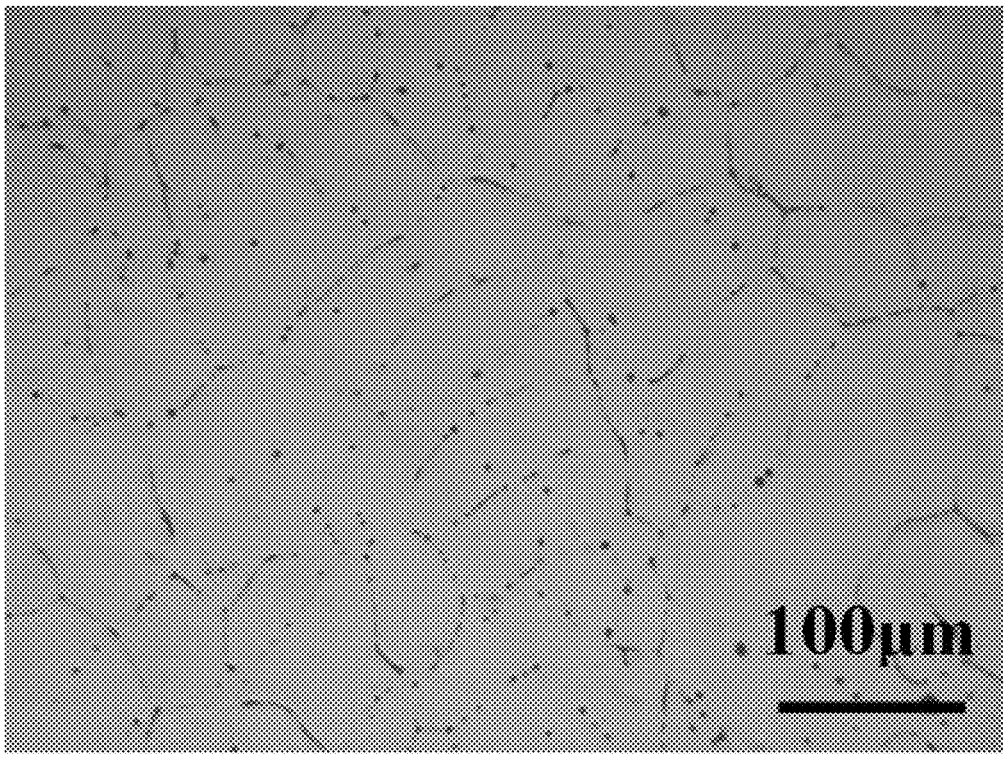
FIG. 4(*a*) is a metallograph of a cast structure of an alloy of Embodiment 1.
Figure 4B:
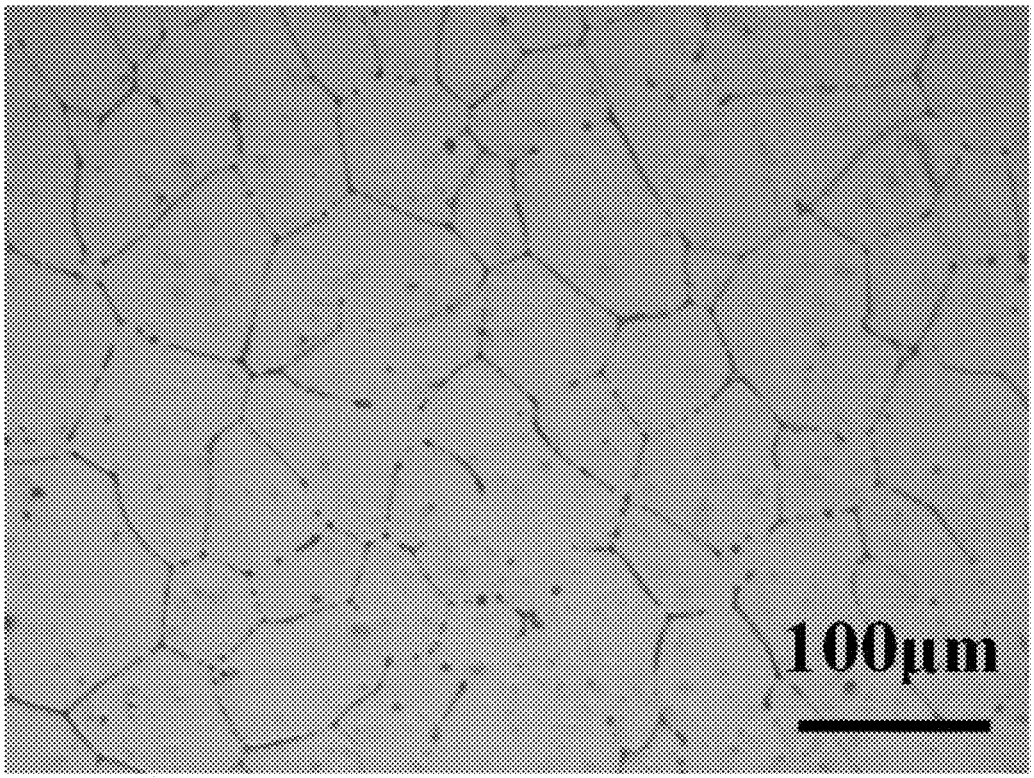

It can be learned from photographs of cast structures shown in FIG. 4(*a*) and FIG. 4(*b*) that in Embodiment 1, a content of an added lanthanum element is relatively low, alloy grains are relatively bulky, and there are many bulky dentritic structures, while in Embodiment 3, a content of an added lanthanum element is relatively high, a grain shape is equiaxed, and grains are obviously refined.

Figure 5A:
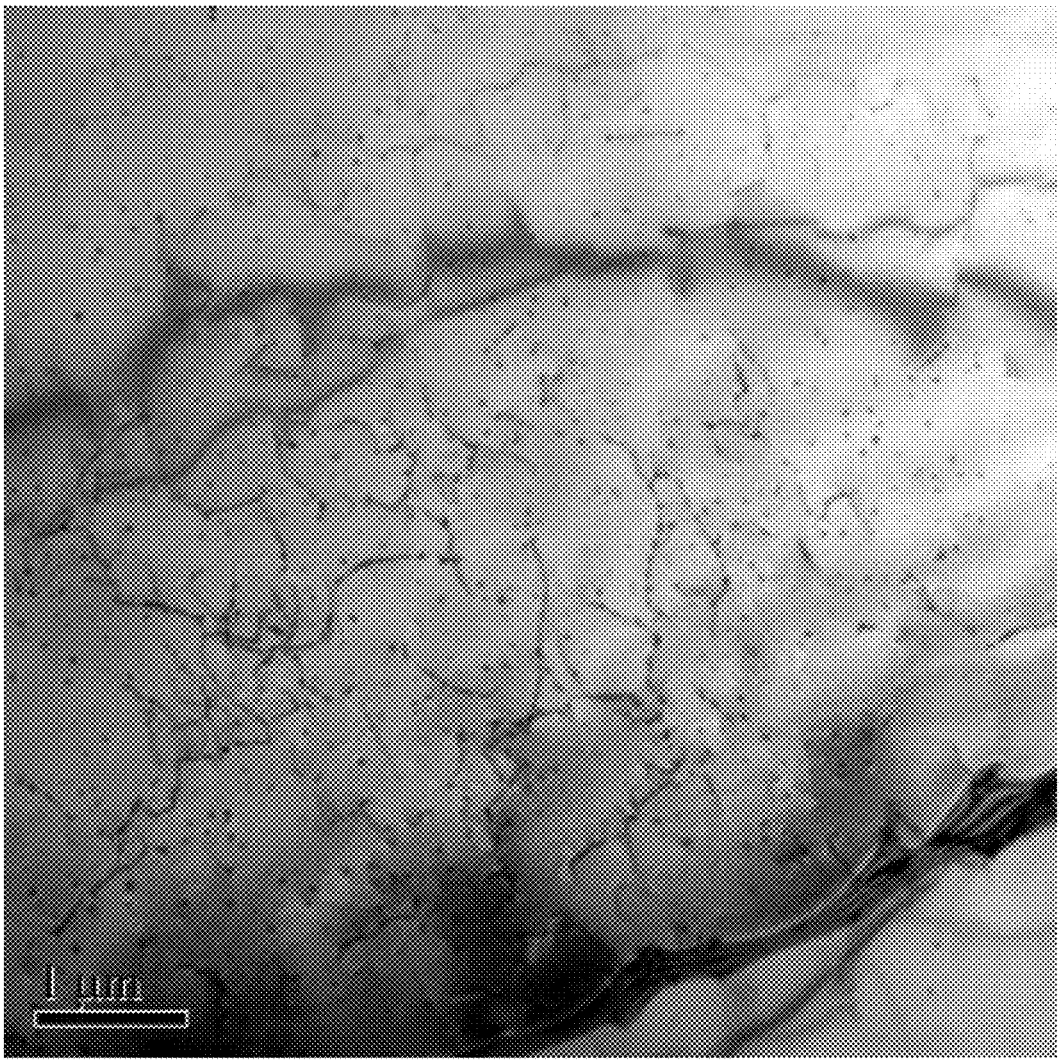
FIG. 5(*a*) is a TEM photograph of an alloy of Embodiment 3, in which there is a second phase pinning dislocation.
Figure 5B:
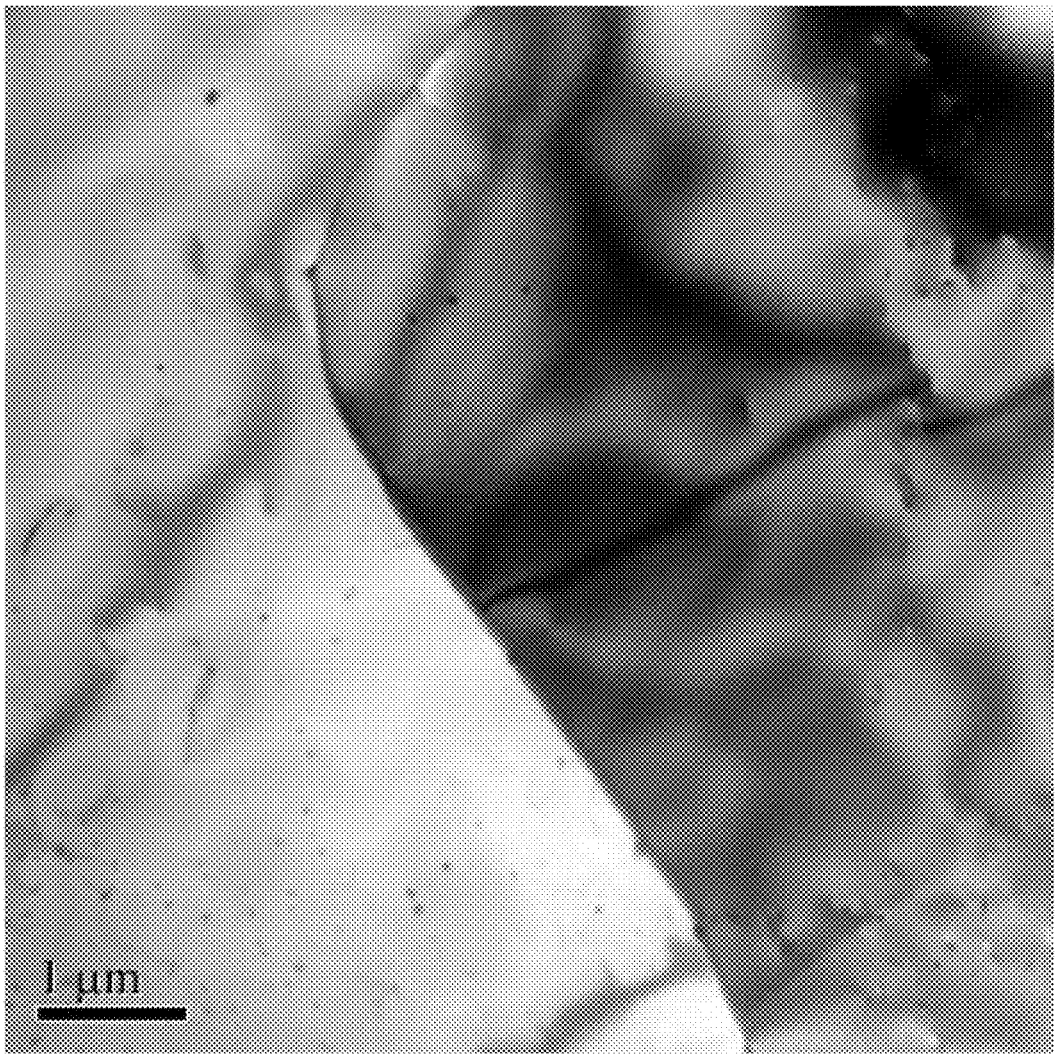

It can be seen from FIG. 5(*a*) that a large number of dispersively-distributed second phase pinning dislocations are precipitated in an alloy matrix, and it can be learned from FIG. 5(*b*) that a second phase is pinned, which prevents a grain boundary from moving.

It can be learned from FIG. 6 to FIG. 9 that an aluminum wire prepared according to the present invention has electrical conductivity up to 62% IACS at 20° C., a short-term heat-resistance temperature as high as 230° C. (a tensile strength survival rate after heating for 1 h at 230° C. is up to 91%), and tensile strength of 170 MPa, which may serve as a forceful supportive proof for the advancement and superiority of the present invention.

Embodiments of the Present Invention

Implementations of the Present Invention

Comparative Example 1

An industrial pure aluminum ingot with purity higher than 99.7%, an Al-2.5% B intermediate alloy, an Al-11.34% Zr intermediate alloy, an Al-31.48% La intermediate alloy, and an Al-9.33% Fe intermediate alloy are used as raw materials; the industrial pure aluminum is first melt at 760° C.; then the aluminum-boron intermediate alloy, the aluminum-zirconium intermediate alloy, the aluminum-lanthanum intermediate alloy, and the aluminum-iron intermediate alloy are added; and percentages by weight of the elements are made to be: 0.035 wt. % for boron, 0.10 wt. % for zirconium, 0.09 wt. % for lanthanum, and 0.10 wt. % for iron. After the intermediate alloys are completely melt, a temperature of the melt is decreased to 740° C. and thermal insulation is performed. A supersaturated solid-dissolved aluminum alloy cast blank is then obtained by stirring, refining, furnace front component rapid analysis, component adjustment, standing, and deslagging, as well as rapid cooling casting. The blank is subject to furnace cooling after annealed at 480° C. for 10 h, and then to hot extrusion at 400° C. at an extrusion ratio of 89.7 and an extrusion deformation amount of 98.7%, to obtain a Φ9.5 round aluminum rod, which is subject to multiple passes of drawing to obtain a Φ4.0 mm aluminum alloy monofilament. Performance of the monofilament is tested, with results shown in Table 1.

TABLE 1

Indicators for Overall Performance of the Aluminum Monofilament of Comparative Example 1

| Density ($g/cm^3$) | Electrical conductivity (% IACS) | Tensile strength (MPa) | Strength survival rate after annealing at 230° C. for 1 h (%) | Strength survival rate after annealing at 210° C. for 400 h (%) |
|---|---|---|---|---|
| 2.710 | 59.5 | 165 | 86.5 | 87.1 |

Embodiment 1

An industrial pure aluminum ingot with purity higher than 99.7%, an Al-2.5% B intermediate alloy, an Al-11.34% Zr intermediate alloy, an Al-31.48% La intermediate alloy, and an Al-9.33% Fe intermediate alloy are used as raw materials; the industrial pure aluminum is first melt at 760° C.; then the aluminum-boron intermediate alloy, the aluminum-zirconium intermediate alloy, the aluminum-lanthanum intermediate alloy, and the aluminum-iron intermediate alloy are added; and percentages by weight of the elements are made to be: 0.04 wt. % for boron, 0.10 wt. % for zirconium, 0.09 wt. % for lanthanum, and 0.10 wt. % for iron. After the intermediate alloys are completely melt, a temperature of the melt is decreased to 740° C. and thermal insulation is performed. A supersaturated solid-dissolved aluminum alloy cast blank is then obtained by stirring, refining, furnace front component rapid analysis, component adjustment, standing, and deslagging, as well as rapid cooling casting. The blank is subject to furnace cooling after annealed at 480° C. for 10 h, and then to hot extrusion at 400° C. at an extrusion ratio of 89.7 and an extrusion deformation amount of 98.7%, to obtain a Φ9.5 round aluminum rod, which is subject to multiple passes of drawing to obtain a Φ4.0 mm aluminum alloy monofilament. Performance of the monofilament is tested, with results shown in Table 2. Electrical conductivity, tensile strength, and heat resistance are all improved when compared to comparative example 1.

TABLE 2

Indicators for Overall Performance of the Aluminum Monofilament of Embodiment 1

| Density ($g/cm^3$) | Electrical conductivity (% IACS) | Tensile strength (MPa) | Strength survival rate after annealing at 230° C. for 1 h (%) | Strength survival rate after annealing at 210° C. for 400 h (%) |
|---|---|---|---|---|
| 2.713 | 62.1 | 170 | 90.5 | 91.1 |

Embodiment 2

An industrial pure aluminum ingot with purity higher than 99.7%, an Al-2.5% B intermediate alloy, an Al-11.34% Zr intermediate alloy, an Al-31.48% La intermediate alloy, and an Al-9.33% Fe intermediate alloy are used as raw materials; the industrial pure aluminum is first melt at 760° C.; then the aluminum-boron intermediate alloy, the aluminum-zirconium intermediate alloy, the aluminum-lanthanum intermediate alloy, and the aluminum-iron intermediate alloy are added; and percentages by weight of the elements are made to be: 0.07 wt. % for boron, 0.15 wt. % for zirconium, 0.19 wt. % for lanthanum, and 0.20 wt. % for iron. After the intermediate alloys are completely melt, a temperature of the melt is decreased to 740° C. and thermal insulation is performed. A supersaturated solid-dissolved aluminum alloy cast blank is then obtained by stirring, refining, furnace front component rapid analysis, component adjustment, standing, and deslagging, as well as rapid cooling casting. The blank is subject to furnace cooling after annealed at 490° C. for 8 h, and then to hot extrusion at 400° C. at an extrusion ratio of 89.7 and an extrusion deformation amount of 98.7%, to obtain a Φ9.5 round aluminum rod, which is subject to multiple passes of drawing to obtain a Φ4.0 mm aluminum alloy monofilament. Performance of the monofilament is tested, with results shown in Table 3.

TABLE 3

Indicators for Overall Performance of the Aluminum Monofilament of Embodiment 2

| Density ($g/cm^3$) | Electrical conductivity (% IACS) | Tensile strength (MPa) | Strength survival rate after annealing at 230° C. for 1 h (%) | Strength survival rate after annealing at 210° C. for 400 h (%) |
|---|---|---|---|---|
| 2.711 | 62.5 | 175 | 90.8 | 91.7 |

Embodiment 3

An industrial pure aluminum ingot with purity higher than 99.7%, an Al-2.5% B intermediate alloy, an Al-11.34% Zr intermediate alloy, an Al-31.48% La intermediate alloy, and an Al-9.33% Fe intermediate alloy are used as raw materials; the industrial pure aluminum is first melt at 760° C.; then the aluminum-boron intermediate alloy, the aluminum-zirconium intermediate alloy, the aluminum-lanthanum intermediate alloy, and the aluminum-iron intermediate alloy are added; and percentages by weight of the elements are made to be: 0.095 wt. % for boron, 0.15 wt. % for zirconium, 0.29 wt. % for lanthanum, and 0.20 wt. % for iron. After the intermediate alloys are completely melt, a temperature of the melt is decreased to 740° C. and thermal insulation is performed. A supersaturated solid-dissolved aluminum alloy cast blank is then obtained by stirring, refining, furnace front component rapid analysis, component adjustment, standing, and deslagging, as well as rapid cooling casting. The blank is subject to furnace cooling after annealed at 500° C. for 2 h, and then to hot extrusion at 400° C. at an extrusion ratio of 89.7 and an extrusion deformation amount of 98.7%, to obtain a Φ9.5 round aluminum rod, which is subject to multiple passes of drawing to obtain a Φ4.0 mm aluminum alloy monofilament. Performance of the monofilament is tested, with results shown in Table 4.

TABLE 4

Indicators for Overall Performance of the Aluminum Monofilament of Embodiment 3

| Density ($g/cm^3$) | Electrical conductivity (% IACS) | Tensile strength (MPa) | Strength survival rate after annealing at 230° C. for 1 h (%) | Strength survival rate after annealing at 210° C. for 400 h (%) |
|---|---|---|---|---|
| 2.714 | 62 | 170 | 91 | 92.3 |

Comparative Example 2

An industrial pure aluminum ingot with purity higher than 99.7%, an Al-2.5% B intermediate alloy, an Al-11.34% Zr intermediate alloy, an Al-31.48% La intermediate alloy, and an Al-9.33% Fe intermediate alloy are used as raw materials; the industrial pure aluminum is first melt at 780° C.; then the aluminum-boron intermediate alloy, the aluminum-zirconium intermediate alloy, the aluminum-lanthanum intermediate alloy, and the aluminum-iron intermediate alloy are added; and percentages by weight of the elements are made to be: 0.12 wt. % for boron, 0.15 wt. % for zirconium, 0.29 wt. % for lanthanum, and 0.20 wt. % for iron. After the intermediate alloys are completely melt, a temperature of the melt is decreased to 740° C. and thermal insulation is performed. A supersaturated solid-dissolved aluminum alloy ingot blank is then obtained by stirring, refining, furnace front component rapid analysis, component adjustment, standing, and deslagging, as well as rapid cooling casting. The blank is subject to furnace cooling after annealed at 500° C. for 2 h, and then to hot extrusion at 400° C. at an extrusion ratio of 89.7 and an extrusion deformation amount of 98.7%, to obtain a Φ9.5 round aluminum rod, which is subject to multiple passes of drawing to obtain a Φ4.0 mm aluminum alloy monofilament. Performance of the monofilament is tested, with results shown in Table 5.

TABLE 5

Indicators for Overall Performance of the Aluminum Monofilament of Comparative Example 2

| Density ($g/cm^3$) | Electrical conductivity (% IACS) | Tensile strength (MPa) | Strength survival rate after annealing at 230° C. for 1 h (%) | Strength survival rate after annealing at 210° C. for 400 h (%) |
|---|---|---|---|---|
| 2.715 | 60.2 | 175 | 90.1 | 90.9 |

A content of boron in comparative example 1 is 0.035 wt. %, and it can be learned from FIG. 3(*a*) and FIG. 3(*b*) that a second phase in the alloy exists mainly in the shape of continuous skeletons, with corresponding electrical conductivity being 59.5% IACS. A content of boron in Embodiment 1 is 0.04 wt. %, and it can be learned from FIG. 3(*c*) and FIG. 3(*d*) that part of a second phase is in the shape of discontinuous short stripes or dots (as shown by the arrow in the figure), with corresponding electrical conductivity being 62.1% IACS. It indicates that an obvious effect for improving the electrical conductivity appears only after the content of boron reaches a certain value. A content of boron in Embodiment 3 is 0.095 wt. %, and it can be learned from FIG. 3(*g*) and FIG. 3(*h*) that an aluminum-iron phase in the alloy exists mainly in the form of discontinuous stripes or dots, with corresponding electrical conductivity being 62% IACS. A content of boron in comparative example 2 reaches 0.12 wt. %, and it can be learned from FIG. 3(*g*) and FIG. 3(*h*) that many bulky aluminum-boron phases are generated in the alloy, with corresponding electrical conductivity being 60.2% IACS. It indicates that an excessively high content of boron causes a decrease in the electrical conductivity.

In summary, the aluminum alloy wires obtained according to the three embodiments of the present invention all have density lower than or equal to 2.714 $g/cm^3$, electrical conductivity greater than or equal to 62% IACS at a room temperature of 20° C., a short-term heat-resistance temperature as high as 230° C. (the strength survival rate after annealing at 230° C. for 1 hour is greater than 90%), and a long-term heat-resistance temperature as high as 210° C. (the strength survival rate after annealing at 210° C. for 400 hours is greater than 90%). The components added in comparative example 1 are the same as those in Embodiment 1, except a smaller quantity of added born elements, and the components added in comparative example 2 are the same as those in Embodiment 3, except a higher content of added boron. However, the electrical conductivity in each of the two comparative examples is lower than 61% IACS, and in comparative example 1, the strength survival rate after annealing at 230° C. for 1 hour is only 86.5%, and the strength survival rate after annealing at 210° C. for 400 hours is only 87.1%.

What is claimed is:

1. A lightweight, high-conductivity, heat-resistant, and iron-containing aluminum wire comprising the following components in percentage by weight:

B 0.04-0.10 wt. %;

Zr 0.10-0.15 wt. %;

Fe 0.10-0.20 wt. %;

La 0.05-0.30 wt. %; and inevitable titanium, vanadium, chromium, and manganese with a total content less than 0.01 wt. %, and aluminum as the remaining.

2. The lightweight, high-conductivity, heat-resistant, and iron-containing aluminum wire according to claim 1, comprising the following components in percentage by weight:

B 0.045-0.095 wt. %;

Zr 0.10-0.15 wt. %;

Fe 0.10-0.20 wt. %;

La 0.05-0.30 wt. %; and inevitable titanium, vanadium, chromium, and manganese with a total content less than 0.01 wt. %, and aluminum as the remaining.

3. The lightweight, high-conductivity, heat-resistant, and iron-containing aluminum wire according to claim 1 wherein during casting, cooling is performed to a room temperature at a rate of 20-300° C./s and then high temperature annealing is performed at 480° C.-500° C. for 1-10 h.

4. The lightweight, high-conductivity, heat-resistant, and iron-containing aluminum wire according to claim 1 wherein the wire has nanoscale spherical $Al_3$(Er, Zr) composite particles.

5. The lightweight, high-conductivity, heat-resistant, and iron-containing aluminum wire according to claim 4, wherein the nanoscale spherical $Al_3$(Er, Zr) composite particles are of an L12 structure coherent with a matrix.

6. The lightweight, high-conductivity, heat-resistant, and iron-containing aluminum wire according to claim 1 wherein the wire has density less than or equal to 2.714 $g/cm^3$, electrical conductivity greater than 62% IACS at 20° C., a short-term heat-resistance temperature as high as 230° C., a long-term heat-resistance temperature as high as 210° C., and tensile strength greater than or equal to 170 MPa.

7. A method for preparing a lightweight, high-conductivity, heat-resistant, and iron-containing aluminum wire, comprising: separately selecting industrial pure aluminum and aluminum-boron, aluminum-zirconium, aluminum-iron and aluminum-lanthanum intermediate alloys according to a designed material component ratio; melting the industrial pure aluminum at 740-780° C.; then adding the intermediate alloys; performing refining and rapid cooling casting to obtain a cast blank; and perform annealing, extrusion, and drawing on the blank to obtain an aluminum alloy monofilament.

8. The method for preparing a lightweight, high-conductivity, heat-resistant, and iron-containing aluminum wire according to claim 7, wherein during the casting, an ingot blank is obtained by common casting or semicontinuous casting; or a rod blank is obtained by continuous casting.

9. The method for preparing a lightweight, high-conductivity, heat-resistant, and iron-containing aluminum wire according to claim 7, wherein during the casting, the cast ingot is cooled to a room temperature at a rate of 20-300° C./s.

10. The method for preparing a lightweight, high-conductivity, heat-resistant, and iron-containing aluminum wire according to claim 9, wherein water-cooling casting is employed during the casting.

11. The method for preparing a lightweight, high-conductivity, heat-resistant, and iron-containing aluminum wire according to claim 8, wherein the ingot blank or the rod blank is subject to the annealing at a temperature of 480° C.-500° C., and is subject to furnace cooling after thermal insulation for 2-10 h.

12. The method for preparing a lightweight, high-conductivity, heat-resistant, and iron-containing aluminum wire according to claim 8, wherein the ingot blank is subject to hot extrusion at a hot extrusion temperature of 300-450° C.; and the rod blank is subject to continuous extrusion at a room temperature.

13. The method for preparing a lightweight, high-conductivity, heat-resistant, and iron-containing aluminum wire according to claim 12, wherein an extrusion ratio for the hot extrusion or the continuous extrusion at the room temperature is greater than or equal to 80, and a total extrusion deformation amount is greater than or equal to 80%.

14. The method for preparing a lightweight, high-conductivity, heat-resistant, and iron-containing aluminum wire according to claim 7, wherein multiple passes of drawing are performed after the extrusion, a coefficient of elongation for the passes being 1.2-1.5 and an accumulative total coefficient of elongation being 5.5-10.5; during the drawing, lubrication and cooling are performed with a common lubricating oil or an emulsion; and a temperature of the aluminum wire is controlled to be less than or equal to 180° C.

15. The method for preparing a lightweight, high-conductivity, heat-resistant, and iron-containing aluminum wire according to claim 14, wherein the prepared wire has density less than or equal to 2.714 g/cm$^3$, electrical conductivity greater than 62% IACS at 20° C., a short-term heat-resistance temperature as high as 230° C., a long-term heat-resistance temperature as high as 210° C., and tensile strength greater than or equal to 170 MPa.

16. The lightweight, high-conductivity, heat-resistant, and iron-containing aluminum wire according to claim 2, wherein during casting, cooling is performed to a room temperature at a rate of 20-300° C./s and then high temperature annealing is performed at 480° C.-500° C. for 1-10 h.

17. The lightweight, high-conductivity, heat-resistant, and iron-containing aluminum wire according to claim 2, wherein the wire has nanoscale spherical $Al_3$(Er, Zr) composite particles.

18. The lightweight, high-conductivity, heat-resistant, and iron-containing aluminum wire according to claim 2, wherein the wire has density less than or equal to 2.714 g/cm$^3$, electrical conductivity greater than 62% IACS at 20° C., a short-term heat-resistance temperature as high as 230° C., a long-term heat-resistance temperature as high as 210° C., and tensile strength greater than or equal to 170 MPa.

19. The method for preparing a lightweight, high-conductivity, heat-resistant, and iron-containing aluminum wire according to any one of claims 8, wherein multiple passes of drawing are performed after the extrusion, a coefficient of elongation for the passes being 1.2-1.5and an accumulative total coefficient of elongation being 5.5-10.5; during the drawing, lubrication and cooling are performed with a common lubricating oil or an emulsion; and a temperature of the aluminum wire is controlled to be less than or equal to 180° C.

20. The method for preparing a lightweight, high-conductivity, heat-resistant, and iron-containing aluminum wire according to any one of claims 9, wherein multiple passes of drawing are performed after the extrusion, a coefficient of elongation for the passes being 1.2-1.5 and an accumulative total coefficient of elongation being 5.5-10.5; during the drawing, lubrication and cooling are performed with a common lubricating oil or an emulsion; and a temperature of the aluminum wire is controlled to be less than or equal to 180° C.

21. The method for preparing a lightweight, high-conductivity, heat-resistant, and iron-containing aluminum wire according to any one of claims 10, wherein multiple passes of drawing are performed after the extrusion, a coefficient of elongation for the passes being 1.2-1.5 and an accumulative total coefficient of elongation being 5.5-10.5; during the drawing, lubrication and cooling are performed with a common lubricating oil or an emulsion; and a temperature of the aluminum wire is controlled to be less than or equal to 180° C.

22. The method for preparing a lightweight, high-conductivity, heat-resistant, and iron-containing aluminum wire according to any one of claims 11, wherein multiple passes of drawing are performed after the extrusion, a coefficient of elongation for the passes being 1.2-1.5 and an accumulative total coefficient of elongation being 5.5-10.5; during the drawing, lubrication and cooling are performed with a common lubricating oil or an emulsion; and a temperature of the aluminum wire is controlled to be less than or equal to 180° C.

23. The method for preparing a lightweight, high-conductivity, heat-resistant, and iron-containing aluminum wire according to any one of claims 12, wherein multiple passes of drawing are performed after the extrusion, a coefficient of elongation for the passes being 1.2-1.5 and an accumulative total coefficient of elongation being 5.5-10.5; during the drawing, lubrication and cooling are performed with a common lubricating oil or an emulsion; and a temperature of the aluminum wire is controlled to be less than or equal to 180° C.

* * * * *